US009239539B2

(12) United States Patent
Yasumoto et al.

(10) Patent No.: US 9,239,539 B2
(45) Date of Patent: Jan. 19, 2016

(54) DEVELOPING DEVICE AND LAYER THICKNESS REGULATING MEMBER

(71) Applicant: CANON KABUSHIKI KAISHA, Tokyo (JP)

(72) Inventors: Takeshi Yasumoto, Abiko (JP); Dai Kanai, Abiko (JP); Koichi Watanabe, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/340,746

(22) Filed: Jul. 25, 2014

(65) Prior Publication Data

US 2015/0043950 A1 Feb. 12, 2015

(30) Foreign Application Priority Data

Aug. 9, 2013 (JP) ..... 2013-166634

(51) Int. Cl.
*G03G 15/08* (2006.01)

(52) U.S. Cl.
CPC ..... *G03G 15/0812* (2013.01)

(58) Field of Classification Search
CPC ..... G03G 15/0812; G03G 15/09
See application file for complete search history.

(56) References Cited

U.S. PATENT DOCUMENTS

| | | | | |
|---|---|---|---|---|
| 5,475,467 | A | 12/1995 | Watanabe et al. | |
| 5,697,021 | A | 12/1997 | Watanabe et al. | |
| 6,044,237 | A | 3/2000 | Numagami et al. | |
| 6,606,469 | B2 | 8/2003 | Kikuchi et al. | |
| 7,336,913 | B2 * | 2/2008 | Sato et al. | 399/103 |
| 7,734,213 | B2 * | 6/2010 | Fukuta et al. | 399/103 |
| 2007/0297827 | A1 * | 12/2007 | Blaine et al. | 399/98 |
| 2014/0255061 | A1 | 9/2014 | Yasumoto et al. | |

FOREIGN PATENT DOCUMENTS

| | | | |
|---|---|---|---|
| JP | 11-095545 | A | 4/1999 |
| JP | 2002-214886 | A | 7/2002 |
| JP | 2005-092092 | A | 4/2005 |
| JP | 2008-090086 | A | 4/2008 |
| JP | 2012-047984 | A | 3/2012 |
| JP | 2012-247757 | A | 12/2012 |

* cited by examiner

*Primary Examiner* — Gregory H Curran
(74) *Attorney, Agent, or Firm* — Fitzpatrick, Cella, Harper & Scinto

(57) ABSTRACT

A developing device includes a developer carrying member and a layer thickness regulating member. The layer thickness regulating member includes an opposing portion, a regulating portion, side wall portions, and a plurality of rib portions each extending from the side wall portion in one end side to the side wall portion in the other end side with respect to the rotational axis direction of the developer carrying member. A space is formed by being defined by the side wall portions and the rib portions. No substantial rib portion dividing the space with respect to a longitudinal direction of said layer thickness regulating member is provided.

44 Claims, 10 Drawing Sheets

(a)

(b)

(a)

(b)

(a)

(b)

(a)

(b)

(a)

(b)

DEVELOPING DEVICE AND LAYER THICKNESS REGULATING MEMBER

FIELD OF THE INVENTION AND RELATED ART

The present invention relates to a developing device in which a layer thickness regulating member formed integrally with a regulating portion for regulating a layer thickness of a developer is provided opposed to a peripheral surface of a developer carrying member, and relates to the layer thickness regulating member. Specifically, the present invention relates to an arrangement structure of reinforcing rib portions formed on the layer thickness regulating member in order to enhance flexural rigidity.

An image forming apparatus including the developing device for developing an electrostatic image, on an image bearing member, into a toner image by carrying the developer on a rotating developer carrying member has been widely used. As shown in FIG. 8, in an ordinary developing device 3E, to a metal-made beam member 75, a metal-made layer thickness regulating member 73 is fixed so as to be positionally adjustable. A layer thickness of the developer carried on a developer carrying member 70 is regulated when the developer passes through between the layer thickness regulating member 73 and the developer carrying member 70.

When the developer passes through an opposing portion between the layer thickness regulating member 73 and the developer carrying member 70, the developer urges the layer thickness regulating member 73 toward a downstream side with respect to a rotational direction of the developer carrying member 70, and therefore, there is a possibility that the layer thickness regulating member 73 is flexed toward the downstream side at a central portion thereof and thus is bent in an arcuate (bow) shape. Further, when the developer passes through the opposing portion between the layer thickness regulating member 73 and the developer carrying member 70, the developer urges, as a reaction force of pressure application, the layer thickness regulating member 73 in an outwardly extended direction, and therefore, there is a possibility that the layer thickness regulating member 73 is flexed outwardly at the central portion and thus is bent in the arcuate shape.

In Japanese Laid-Open Patent Application (JP-A) 2002-214886, a layer thickness regulating member itself is subjected to press working to be provided with a projected reinforcing structure continuously extending in a longitudinal direction of the layer thickness regulating member, so that sufficient flexural rigidity against an urging force directed toward a downstream side with respect to a rotational direction of a developer carrying member and an urging force for extending an opposing portion toward an outside is ensured.

In JP-A 2012-247757, a developing device in which a beam member is provided between a pair of supporting members for rotatably supporting a developer carrying member to assemble a developer carrying member and a layer thickness regulating member into an exchanging (replacing) unit. The beam member has a cross-sectional shape having high flexural rigidity and is supported between the pair of supporting members at their end portions. As shown in FIG. 8, the metal-made layer thickness regulating member is fixed to the beam member with screws at a plurality of positions with respect to the longitudinal direction thereof.

In order to reduce the number of parts, a constitution in which a beam member and a layer thickness regulating member portion were integrally molded by using a single material to prepare a single layer thickness regulating member was proposed. As shown in FIG. 10, a layer thickness regulating member in which at an opposing surface to a developer carrying member of a layer thickness regulating member, a layer thickness regulating portion 36 for regulating a layer thickness of a developer was provided, and at a surface opposite from the opposing surface, lattice-shaped reinforcing rib portions (38 and 39) were provided was proposed. In order to save the material used for the layer thickness regulating member while ensuring the sufficient flexural rigidity against the urging forces from the developer as described above, a waffle-like reinforcing structure was constituted by bonding longitudinal reinforcing rib portions extending in a rotational axis direction of the developer carrying member and vertical reinforcing rib portions extending in a rotational direction of the developer carrying member to each other.

However, a prototype of such a layer thickness regulating member was prepared, and when a durability test in which a cycle of image formation of 100 sheet and then was in rest for several hours was repeated was conducted, a phenomenon that the layer thickness regulating member gradually flexed at a central portion thereof and thus permanently deformed in the arcuate shape was confirmed. When optical analysis of distortion was made by using the prototype, a phenomenon that the distortion generated at a portion where the longitudinal reinforcing rib portion and the vertical reinforcing rib portion were bonded to each other and gradually increased with repetition of heat cycle of heating and cooling was confirmed.

SUMMARY OF THE INVENTION

A principal object of the present invention is to provide a developing device, which is not readily flexed outwardly at a central portion thereof with respect to a developer carrying member rotational axis direction of a layer thickness regulating member with repetition of heat cycle of heating and cooling, capable of forming a uniform layer thickness of a developer along the developer carrying member rotational axis direction.

According to an aspect of the present invention, there is provided a developing device comprising: a developer carrying member for carrying a developer; and a layer thickness regulating member, integrally molded by a resin material, for regulating a layer thickness of the developer carried on the developer carrying member, wherein the layer thickness regulating member includes: an opposing portion opposing a peripheral surface of the developer carrying member; a regulating portion, provided on the opposing portion so as to project toward the developer carrying member, for regulating the layer thickness of the developer carried on the developer carrying member; side wall portions which are provided on the opposing portion so as to project in a rear side opposite from a front side where the regulating portion is provided and which are provided at end portions thereof with respect to a rotational axis direction of the developer carrying member; and a plurality of rib portions, provided on the opposing portion so as to project in the rear side, each extending from the side wall portion in one end side to the side wall portion in the other end side with respect to the rotational axis direction of the developer carrying member, wherein a space is formed in the rear side by being defined by the side wall portions and the rib portions, and wherein substantial no rib portion dividing the space with respect to a longitudinal direction of said layer thickness regulating member is provided.

According to another aspect of the present invention, there is provided a developing device comprising: a developer carrying member for carrying a developer; and a layer thickness regulating member, integrally molded by a resin material, for regulating a layer thickness of the developer carried on the developer carrying member, wherein the layer thickness regulating member includes: an opposing portion opposing a peripheral surface of the developer carrying member; a regulating portion, provided on the opposing portion so as to project toward the developer carrying member, for regulating the layer thickness of the developer carried on the developer carrying member; and a plurality of rib portions, provided on the opposing portion so as to project in the rear side, each extending from one end side to the other end side with respect to the rotational axis direction of the developer carrying member, and wherein with respect to geometrical moment of inertia of the developer carrying member with respect to a tangential direction at a position opposing the regulating portion, of the plurality of the rib portions, the rib portion occupying 30% or more of total geometrical moment of inertia is provided so as to be connected with substantial no rib portion extending in a direction crossing the rotational axis direction of the developer carrying member except for the rib portions provided at end portions with respect to the rotational axis direction of the developer carrying member.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be specifically described with reference to the drawings.

(Image Forming Apparatus)

Figure 1:
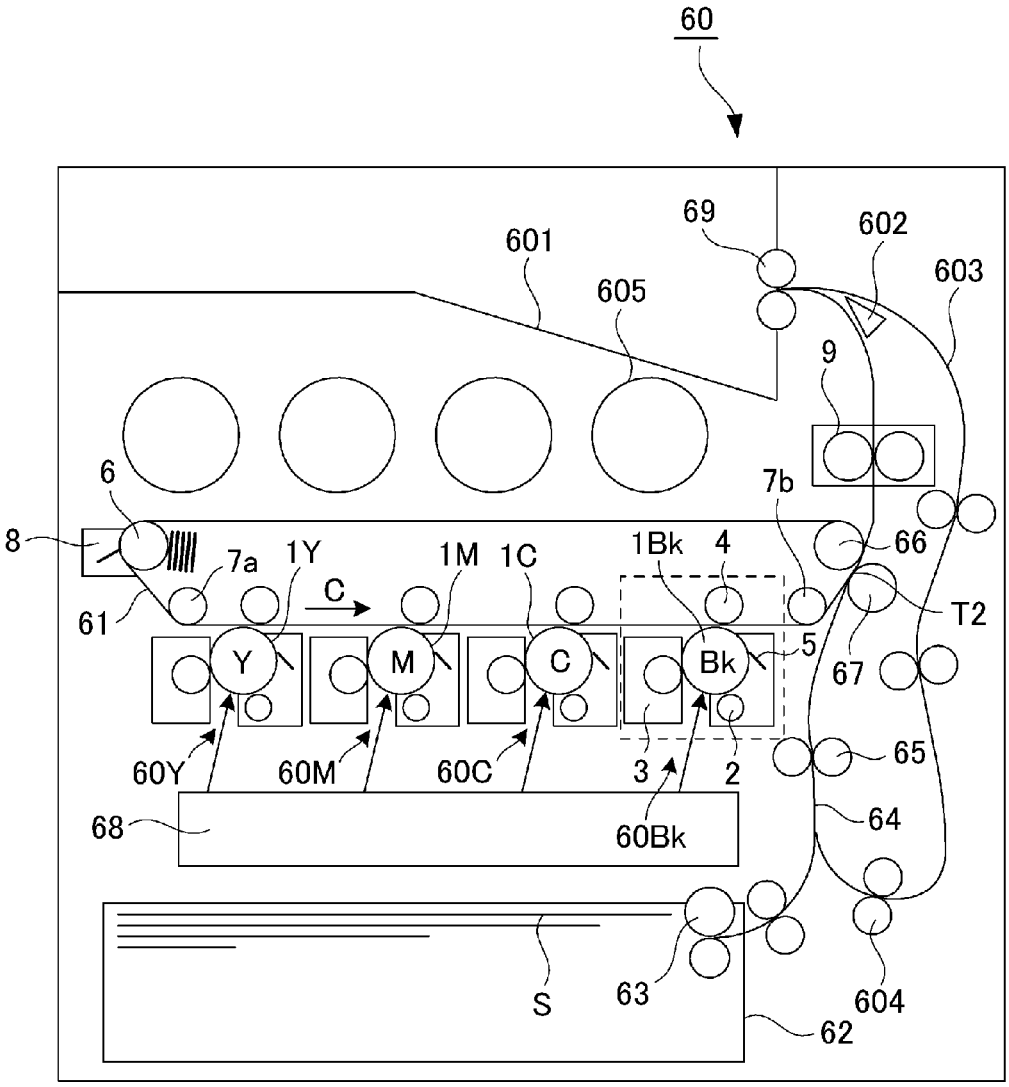
FIG. 1 is an illustration of a structure of an image forming apparatus.

FIG. 1 is an illustration of a structure of an image forming apparatus 60. As shown in FIG. 1, the image forming apparatus 60 is an intermediary transfer type full color printer of a tandem type in which image forming portions 60Y, 60M, 60C and 60Bk are arranged along a downward surface of an intermediary transfer belt 61.

At the image forming portion 60Y, a yellow toner image is formed on a photosensitive drum 1Y and then is transferred onto the intermediary transfer belt 61. At the image forming portion 60M, a magenta toner image is formed on a photosensitive drum 1M and then is transferred onto the intermediary transfer belt 61. At the image forming portions 60C and 60Bk, cyan and black toner images are formed on photosensitive drums 1C and 1Bk, respectively, and then are transferred onto the intermediary transfer belt 61.

The four color toner images transferred on the intermediary transfer belt 61 are conveyed to a secondary transfer portion T2 and are secondary-transferred onto the recording material S. A separation roller 63 separates sheets of the recording material S, one by one, pulled out from a recording material cassette 62, and then feeds the recording material S to a registration roller pair 65. The registration roller pair 65 sends the recording material S to the secondary transfer portion T2 while being timed to the toner images on the intermediary transfer belt 61. The recording material P on which the four color toner images are secondary-transferred is pressed and heated by a fixing device 9, so that the toner images are fixed on a surface of the recording material S.

(Image Forming Portion)

The image forming portions 60Y, 60M, 60C and 60Bk have the substantially same constitution except that colors of toners used in developing devices 3 are yellow, magenta, cyan and black, respectively, which are different from each other. In the following, the image forming portion 60Bk is described, and redundant explanation about other image forming portions 60Y, 60M and 60C will be omitted.

The image forming portion 60Bk includes, at a periphery of the photosensitive drum 1Bk, a charging device 2, an exposure device 68, the developing device 3, a transfer roller 4 and a drum cleaning device 5. The photosensitive drum 1Bk is prepared by forming a photosensitive layer on an outer peripheral surface of an aluminum cylinder, and is rotated at a predetermined process speed.

The charging device 2 electrically charges a surface of the photosensitive drum 1Bk to a negative potential uniformly by applying, to a charging roller, an oscillating voltage in the form of a negative (−polarity) DC voltage biased with an AC voltage. The exposure device 68 scans the surface of the photosensitive drum 1K with a laser beam, obtained by ON-OFF modulation of a scanning line image signal developed from an associated color image, through a rotating mirror, so that an electrostatic image for an image is written (formed) on the surface of the photosensitive drum 1Bk. The developing device 3 develops the electrostatic image into a toner image by transferring the toner onto the photosensitive drum 1Bk. A fresh toner in an amount corresponding to an amount of the toner consumed in the developing device 3 by image formation is supplied from a toner cartridge 605 to the developing device 3 via an unshown toner feeding path.

The transfer roller 4 presses the intermediary transfer belt 61 to form a transfer portion between the photosensitive drum 1Bk and the intermediary transfer belt 61. By applying a positive DC voltage to the transfer roller 4, the negative toner image carried on the photosensitive drum 1Bk is transferred onto the intermediary transfer belt 61. The drum cleaning device 5 removes a transfer residual toner deposited on the surface of the photosensitive drum 1Bk by sliding a cleaning blade on the surface of the photosensitive drum 1Bk.

The intermediary transfer belt 61 is extended around and supported by a tension roller 6, a driving roller 66 also functioning as a secondary transfer opposite roller, and stretching rollers 7*a* and 7*b*, and is driven by the driving roller 66 to be rotated in an arrow C direction. A secondary transfer roller 67 contacts the intermediary transfer belt 61 supported at an inside surface thereof by the driving roller 66 to form the secondary transfer portion T2. By applying a positive DC voltage to the secondary transfer roller 67, the toner image on the intermediary transfer belt 61 is transferred onto the recording material S. A belt cleaning device 8 collects the transfer residual toner on the surface of the intermediary transfer belt 61 by rubbing the intermediary transfer belt 61 with a cleaning blade.

Embodiment 1

Figure 2:
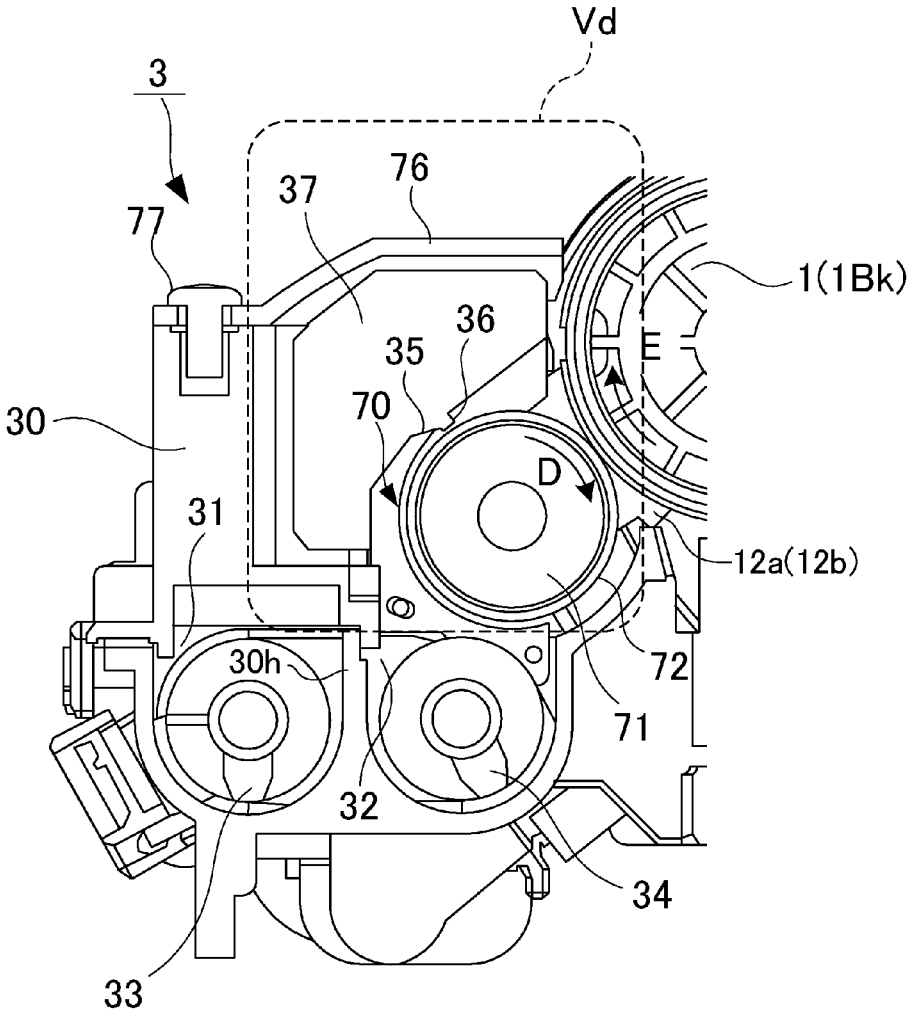
FIG. 2 is an illustration of a structure of a developing device in Embodiment 1.

As shown in FIG. 2, a developing sleeve 70 as an example of a developer carrying member carries the developer and develops, into the toner image, the electrostatic image on the photosensitive drum 1 as an example of an image bearing member.

Figure 3:
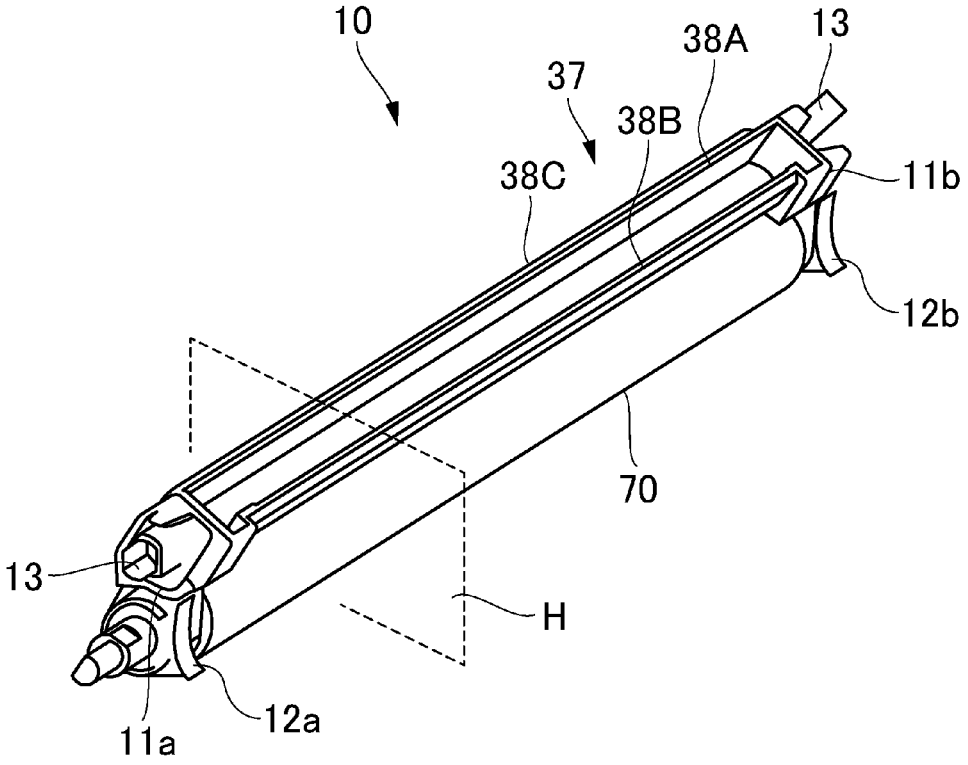
FIG. 3 is a perspective view of a developing sleeve unit.

As shown in FIG. 3, the developing sleeve 70 is rotatably supported, at end portions thereof with respect to a rotational axis direction thereof, by free end-side bearing portions of sleeve bearing members 11*a* and 11*b* as an example of a supporting member.

A layer thickness regulating member 37 is supported movably in the rotational axis direction of the developer carrying member so that expansion and contraction thereof with heat cycle of heating and cooling does not generate bending moment in the layer thickness regulating member 37. A developing container 30 shown in FIG. 2 holds positioning shafts 13 of the sleeve bearing members 11*a* and 11*b* shown in FIG. 3 so as to be slidable in the developer carrying member (rotational) axis direction.

Figure 4:
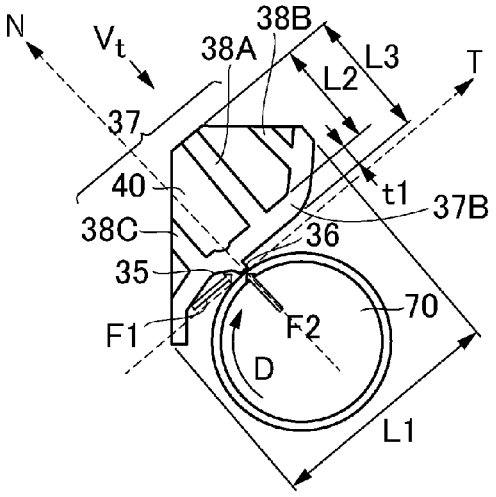
In FIG. 4, (*a*) and (*b*) are illustrations of a reinforcing structure for a layer thickness regulating member in Embodiment 1.
Figure 4:
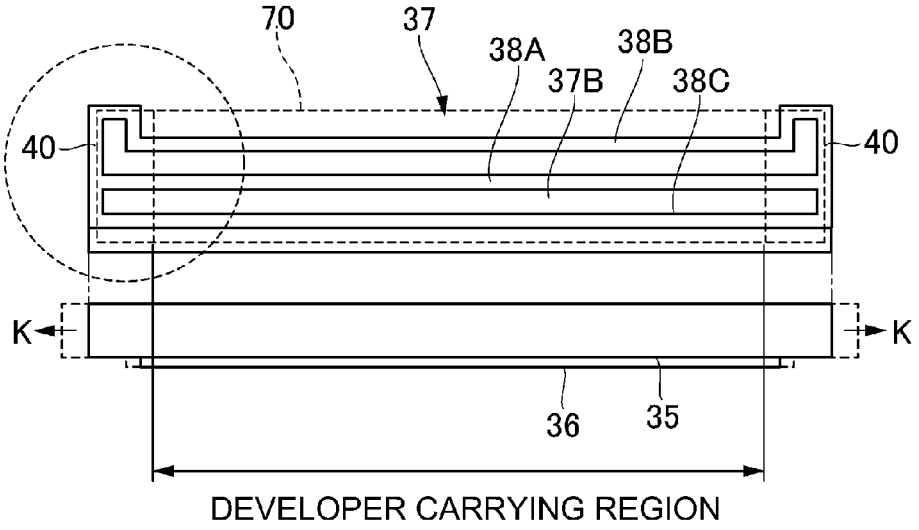

As shown in (a) of FIG. 4, a base surface 37B as an example of an opposing portion extends from a layer thickness regulating portion 36 as an example of a regulating portion in a movement direction of the developing sleeve 70, and opposes a peripheral surface of the developing sleeve 70. The layer thickness regulating member 37 is provided with at least one rib which is disposed so as to project in a rear side of the base surface 37B and which extends from one end side to the other end side with respect to the developer carrying member axis direction. The layer thickness regulating member 37 is prepared by integrally molding, with a resin material in the rear side of the base surface 37B, a rib portion and side wall portions provided at end portions thereof with respect to the rotational axis direction of the developing sleeve 70. The layer thickness regulating member 37 is bonded and fixed, at the end portions thereof with respect to the developer carrying member axis direction, to surfaces of the sleeve bearing members 11*a* and 11*b* each in a base portion side. The sleeve bearing members 11*a* and 11*b* support the layer thickness regulating member 37 so that the layer thickness regulating member 37 is extended between end portions thereof in a beam shape.

The layer thickness regulating portion 36 regulates a layer thickness of the developer to be carried on the developing sleeve 70. The base surface 37B is extended along the layer thickness regulating portion 36 in a direction of crossing the layer thickness regulating portion 36 so as to oppose the peripheral surface of the developing sleeve 70. A reinforcing rib portion 38A is provide so as to project from a surface (side), opposite from a surface (side), where the layer thickness regulating portion 36 is disposed, of the base surface 37B so that the reinforcing rib portion 38A extends from one end side to the other end side in the developer carrying member axis direction at the base surface 37B. A developer rectifying portion 35 as an example of a rectifying portion is a developer carrying member opposing surface of the base surface 37B. The developer rectifying portion 35 rectifies the developer upstream of the layer thickness regulating portion 36.

As shown in (b) of FIG. 4, with respect to the reinforcing rib portion 38A, except for the end portions of the layer thickness regulating member 37 with respect to the developer carrying member axis direction, a vertical reinforcing rib (vertically) extending in a direction of crossing the developer carrying member axis direction while being connected with both the base surface 37A and the reinforcing rib portion 38A is not substantially formed.

As shown in (a) of FIG. 4, the regulating portion 38A is an example of a longitudinal reinforcing rib portion, of a plurality of longitudinal reinforcing rib portions, having the largest height from the regulating portion. The reinforcing rib portion 38A is an example of a longitudinal reinforcing rib portion, of the plurality of longitudinal reinforcing rib portions, which is 30% or more in proportion of geometrical moment of inertia to total geometrical moment of inertia in a whole cross-section, of the layer thickness regulating member 37, perpendicular to the developer carrying member axis direction.

(Process Cartridge)

As shown in FIG. 1, each of the image forming portions 60Y, 60M, 60C and 60Bk is prepared by integrally assembling portions excluding the exposure device 68 and the transfer roller 4 into a unit as a process cartridge which is an exchanging (replacing) unit for associated one of the colors. Each of the image forming portions 60Y, 60M, 60C and 60Bk is detachably mounted to an apparatus main assembly frame of the image forming apparatus 100. The transfer roller 4 is incorporated in an intermediary transfer unit including the intermediary transfer belt 61. The process cartridge is prepared by integrally assembling the image forming portion 60 Bk including the developing device 3 into a unit, and is detachably mountable to the image forming apparatus 100.

Incidentally, depending on some image forming apparatus, there is also the case where the drum cleaning device 5 is provided as an independent exchanging unit. There is also the case where the drum cleaning device 5 and the charging device are provided as an independent exchanging unit, and the photosensitive drum 1Bk and the developing device 3 are provided as a single process cartridge.

(Developing Device)

FIG. 2 is an illustration of a structure of the developing device 3 in Embodiment 1. As shown in FIG. 2, in the developing device 3, a two-component developer containing a (non-magnetic) toner and a (magnetic) carrier in mixture is stored in the developing container 30. The developing device 3 electrically charges the developer stored in the developing container 30, and then supplies the toner to the electrostatic image on the photosensitive drum 1Bk while carrying the charged developer on the surface of the developing sleeve 70.

The developing device 3 includes the developing sleeve 70 at an opening toward the photosensitive drum 1Bk. Below the developing sleeve 70, a first feeding screw 33 and a second feeding screw 34 are provided. The developing sleeve 70 and the first and second feeding screws 33 and 34 are rotationally driven integrally by being connected with gear trains provided at associated shaft ends outside the developing container 30.

The developing container 30 is partitioned into a first feeding chamber 31 and a second feeding chamber 32 by a partition wall 30*h*. The first and second feeding chambers 31 and 32 communicate with each other through an opening, of the partition wall 30*h*, formed at each of longitudinal end portions of the partition wall 30*h*. The first feeding screw 33 is disposed in the first feeding chamber 31, and the second feeding screw 34 is disposed in the second feeding chamber 32. By driving the first and second feeding screws 33 and 34, the developer is delivered through the openings of the partition wall 30*h*, so that the developer is circulated between the first and second feeding chambers 31 and 32. In a process in which the developer is fed while being stirred by the first and second feeding screws 33 and 34, the carrier and the toner in the developer are triboelectrically charged to the positive polarity and the negative polarity, respectively.

The developing sleeve 70 is supported rotatably around a magnet portion 71 supported non-rotatably by the developing container 30, and opposes the second feeding screw 34 with respect to a circumferential direction. The second feeding screw 34 supplies the developer to the developing sleeve 70 while feeding the developer in the second feeding chamber 32. The supplied developer is carried on the surface of the developing sleeve 70 by a magnetic force of the magnet portion 71 and is fed in an arrow D direction.

The magnet portion 71 generates a magnetic field for magnetically carrying the developer on the surface of the rotating developing sleeve 70. Magnetic poles of the magnet portion 71 are fixed at predetermined phase positions with respect to the circumferential direction and are supported non-rotatably, and therefore magnetic pole patterns formed on the surface of the developing sleeve 70 are fixed at predetermined phases with respect to the circumferential direction. Around the magnet portion 71, only a sleeve pipe 72 constituting an outer shell of the developing sleeve 70 is supported rotatably. The carrier and the toner in the developer are carried in an erected chain shape on the surface of the developing sleeve 70 in a deposited state by triboelectric charge at associated magnetic polarity positions of the magnet portion 71.

The developing sleeve 70 opposes the second feeding screw 34, the developer rectifying portion 35, the layer thickness regulating portion 36 and the photosensitive drum 1 in the listed order along the rotational direction thereof. The developer rectifying portion 35 constitutes a guide when the developer is fed. The developer carried on the developing sleeve 70 rotating in the arrow D direction passes through the developer rectifying portion 35, and then the layer thickness of the developer is regulated by the layer thickness regulating portion 36. Stagnation of the developer is formed in a space defined by the developer rectifying portion 35 and the developing sleeve 70 in front of the layer thickness layer thickness regulating portion 36, so that a density of the developer with respect to the rotational axis direction of the developing sleeve 70 is uniformized.

The layer thickness regulating member (sleeve holder frame) 37 causes a free end of the layer thickness regulating portion 36 to oppose the surface of the developing sleeve 70. The chain-shaped developer erected by the magnetic field of the developing sleeve 70 is fed toward the layer thickness regulating portion 36. A gap between the free end surface of the layer thickness regulating portion 36 and the surface of the developing sleeve 70 is set in a desired range, and therefore the erected chain-shaped developer forms a uniform thickness coating layer by passing through the layer thickness regulating portion 36.

An opposing distance between the developing sleeve 70 and the photosensitive drum 1 which are disposed opposed to each other is set at a predetermined value (300 μm) by abutment portions 12*a* and 12*b* formed on the sleeve bearing members 11*a* and 11*b* (FIG. 3) for supporting the rotation shaft of the developing sleeve 70. The opposing distance between the developing sleeve 70 and the photosensitive drum 1 is referred to as SD gap. The electrostatic image on the photosensitive drum 1 is developed by the magnetic chain rubbing the surface of the photosensitive drum 1 in a height exceeding the SD gap. The rotational direction D of the developing sleeve 70 is set as a counter direction to the rotational direction E of the photosensitive drum 1, but may also be the same direction as the rotational direction at the opposing portion.

(Developing Sleeve Unit)

FIG. 3 is a perspective view of a developing sleeve unit 10. In FIG. 4, (a) and (b) are illustrations of a reinforcing structure for the layer thickness regulating member 37 in Embodiment 1. In FIG. 4, (a) is a schematic sectional view of a layer thickness regulating portion Vd of the developing device 3 shown in FIG. 2, and also shows a cross-section H in FIG. 3, and (b) is the illustration of arrangement of a reinforcing rib portion as seen from an arrow Vt direction in (a) of FIG. 4.

As shown in FIG. 3, the developing sleeve unit 10 is an exchanging unit prepared by integrally assembling the developing sleeve 70, the sleeve bearing members 11*a* and 11*b* and the layer thickness regulating member 37 into a unit. An attitude of the developing sleeve unit 10 is held relative to the developing container 30 by a pair of positioning shafts 13 with which the sleeve bearing members 11*a* and 11*b* are provided.

The developing sleeve 70 is supported at end portions thereof rotatably by the sleeve bearing members 11*a* and 11*b*. Cylindrical shafts projecting from ends of the developing sleeve 70 are inserted into bearings (sintered bearings) engaged in the sleeve bearing members 11*a* and 11*b*. The layer thickness regulating member 37 is disposed between the pair of sleeve bearing members 11*a* and 11*b*. The sleeve bearing members 11*a* and 11*b* are fixed at the end portions of the layer thickness regulating member 37. The layer thickness regulating member 37 is provided with reinforcing rib portions 38A, 38B and 38C on a surface (side) opposite from a surface (side) where the layer thickness regulating member 37 opposes the developing sleeve 70. The layer thickness regulating member 37 is an integrally molded part (component) formed of a resin material and constitutes a part of a portal frame member holding the developing sleeve 70.

As shown in (a) of FIG. 4, the layer thickness regulating member 37 is provided with the layer thickness regulating member 37 and the developer rectifying portion 35 in a side where the base surface (side) 37B having a base thickness t7 opposes the developing sleeve 70. The layer thickness regulating member 37 is resin-molded integrally by using the resin material. The base surface 37B, the layer thickness regulating portion 36 and the reinforcing rib portions 38A, 38B and 38C are integrally constituted as a shape of the layer thickness regulating member 37. As the resin material used for the layer thickness regulating member 37, a resin material having relatively high rigidity such as a PC+AS resin material or a PC+ABS resin material is selected.

An SB gap is formed at the closest portion between the layer thickness regulating portion 36 and the developing sleeve 70. Adjustment of the SB gap is made by moving a position of the layer thickness regulating member 37 as a whole relative to the sleeve bearing members 11*a* and 11*b*. For example, while keeping a state in which an SB gap value falling within a desired range is confirmed by a TV camera or the like, the layer thickness regulating member 37 is fixed to the sleeve bearing members 11*a* and 11*b*, thus being assembled into a unit as a whole. As a fixing method thereof, screws or the like may be used. However, in the case where the layer thickness regulating member 37 and the sleeve bearing members 11*a* and 11*b* are formed of the resin material, it is desirable that the fixing method such as laser welding or UV bending is selected. Compared with the screws or the like, the laser welding or the UV bonding is capable of suppressing a degree of torsion between the members with the fixing to a small amount.

(Reinforcing Rib Portion)

As shown in (a) of FIG. 4, in order to obtain rigidity against a load exerted on the layer thickness regulating member 37 during the image formation in consideration of the load, a particular reinforcing structure is added to the layer thickness regulating member 37.

As the load exerted on the layer thickness regulating portion 36 during the image formation, a force F1 acting in a direction which is a developer feeding direction and which is a substantially tangential direction of the SB gap G and a force F2 acting in a substantially normal direction on the layer thickness regulating portion 37 when the developer passes through the SB gap G to be subjected to layer thickness regulation are representative thereof.

With respect to the layer thickness regulating member 37, in order to ensure rigidity against the force F1, a shape of the base surface 37B having a length L1 with respect to the substantially same direction as the force F1 direction is designed. Further, with respect to the layer thickness regulating member 37, in order to ensure rigidity against the force F2, the reinforcing rib portion 38A having a maximum height L2 with respect to the substantially same direction as the force F2 direction is designed.

As shown in (b) of FIG. 4, in this embodiment, with respect to the layer thickness regulating member 37, only the reinforcing rib portions 38A, 38B and 38C are disposed. The reinforcing rib portion 38A having the height L2 dominating geometrical moment of inertia against the force F2 as shown in (a) of FIG. 4 is disposed so as to connect wall ribs 40 provided at end portions of the layer thickness regulating member 37 as shown in (b) of FIG. 4, so that a box-like shape is constituted among the wall ribs 40 and the base surface 37B. By a reinforcing effect of this box-like shape, a degree of flexure (bending) of the layer thickness regulating member 37 by the forces F1 and F2 is suppressed to a desired value or less even when the layer thickness regulating member 37 is a resin-molded product. That is, a box-like space is formed in a rear side of the layer thickness regulating member 37 by being defined by the wall ribs 40 and the reinforcing rib portions 38A to 38C. This box-like space defined by the wall ribs 40 and the reinforcing rib portions 38A to 38C is divided into a plurality portions with respect to a short direction (height direction) of the layer thickness regulating member 37, but is constituted so as not to be divided with respect to a long direction (longitudinal direction) of the layer thickness regulating member 37. In other words, in this embodiment, in order not to divide the box-like space with respect to the longitudinal direction, a rib extending and crossing the axis direction of the developing sleeve is not substantially formed in the rear side of the layer thickness regulating member 37.

Effect of Embodiment 1

As shown in (b) of FIG. 4, in Embodiment 1, a reinforcing rib portion (vertical rib) crossing the reinforcing rib portions 38A, 38B and 38C is not formed at all in an intermediary section except for the wall ribs 40. For this reason, a degree of warpage of the layer thickness regulating member 37 becomes small against heat contraction immediately after the molding and expansion and contraction in the case where a temperature and a humidity in an operation environment of the image forming apparatus 60 (FIG. 1) fluctuate.

In the developing device in Embodiment 1, the reinforcing rib portion crossing the reinforcing rib portions 38A, 38B and 38C is not disposed, and therefore with respect to the reinforcing rib portions 38A, 38B and 38C, there is no place where heat distortion generates with a temperature change due to a constraint by the reinforcing rib portion crossing the reinforcing rib portions 38A, 38B and 38C at an intermediary portion. For that reason, there is no room for generation of a problem such that local heat distortion generates at the intermediary portion with respect to the longitudinal direction of the reinforcing rib portions 38A, 38B and 38C to flex (bend) the layer thickness regulating member 37 as a whole. A local difference in thermal stress generated in the layer thickness regulating member 37 is not readily generated, and therefore, the layer thickness regulating member 37 is displaced substantially uniformly in arrow K directions with temperature rise.

In the developing device in Embodiment 1, pins are inserted from the developing container side into the cylindrical positioning shafts 13 shown in FIG. 3, so that the layer thickness regulating member 37 is movable along the pins. The developing device is designed so that the expansion and contraction of the layer thickness regulating member 37 in the arrow K directions shown in (b) of FIG. 4 are absorbed by an associated space between the developing sleeve unit 10 and the developing container 30 (FIG. 2). For this reason, the layer thickness regulating member 37 easily expands and contracts with a heat cycle of heating and cooling, thus causing no interference with the developing container and no buckling phenomenon of the layer thickness regulating member 37. Even when the temperature and the humidity in the operation environment are largely changed, no inconvenience such as contact between the members is generated.

In the developing device in Embodiment 1, by optimizing the arrangement of the regulating portions, influences of straightening and warpage of the layer thickness regulating member including the layer thickness regulating portion and the developer rectifying portion are reduced. By providing the layer thickness regulating member 37 with only the reinforcing rib portions 38A, 38B and 38C, even when the flexure (bending) by the forces F1 and F2 and the warpage due to thermal deformation are included, the straightness of the layer thickness regulating portion 36 can be suppressed to 20-30 μm or less. As a result, even in a process in which the layer thickness regulating member 37 is changed in shape with the temperature, a uniform coating amount of the developer can be stably realized with respect to the longitudinal direction of the developing sleeve 70. Throughout an actuation and temperature rise process of the developing device 3, a variation in longitudinal layer thickness distribution of the developer carried on the developing sleeve 70 can be suppressed. As a result, the image density can be stably maintained also against the load received from the developer and the change in operation environment (temperature and humidity). A stable image density with less variation can be outputted on a screen.

In the developing device in Embodiment 1, the layer thickness regulating portion 36 is integrally assembled with the layer thickness regulating member 37, and therefore the developing sleeve unit 10 can be constituted in a small size, so that the downsized developing device unit 10 can contribute to downsizing and weight reduction of the developing device 3. The layer thickness regulating member which is inexpensive but which has high precision and high rigidity is realized, so that the developing device capable of obtaining a stable developed image density can be provided. The integral formation of the developer rectifying portion 35 and the layer thickness regulating portion 36 with the layer thickness regulating member 37 has the advantage such that large geometrical moment of inertia is easily ensured in terms of flexural rigidity against the above-described forces F1 and F2.

In the developing device in Embodiment 1, the layer thickness regulating portion 36 and the developer rectifying portion 35 can be manufactured in an inexpensive processing method by using an inexpensive material in a resin molding process. It is possible to realize a developer layer thickness-regulated structure which is inexpensive but which has high precision and high rigidity. By replacing the material for the layer thickness regulating member 37 with the resin material, reductions in weight and cost of the member are realized. The resin material has a high degree of flexibility in molding process, and therefore even when the resin material has low rigidity, it becomes possible to enhance the rigidity by using the ribs in combination while suppressing the warpage and the flexure due to the thermal deformation.

In the developing device in Embodiment 1, the layer thickness regulating member 37 as a base member is formed integrally with the developer rectifying portion 35 and the layer thickness regulating portion 36, so that there is no need to adjust the SB gap after the assembling. A cumbersome SB gap adjustment operation performed in the conventional developing device is simplified.

In the developing device in Embodiment 1, the layer thickness regulating portion 36 is formed integrally with the layer thickness regulating member 37, and therefore it is possible to avoid generation of metal powder with fastening and fixing of the developing blade with screws. As the material for the layer thickness regulating member 37, the resin material is used, and therefore a factor of inclusion of the metal power in the developer can be remarkably reduced.

Embodiment 2

Figure 5:
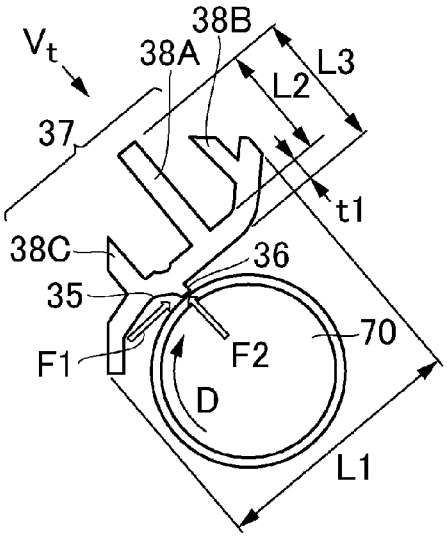
In FIG. 5, (*a*) and (*b*) are illustrations of a reinforcing structure for a layer thickness regulating member in Embodiment 2.
Figure 5:
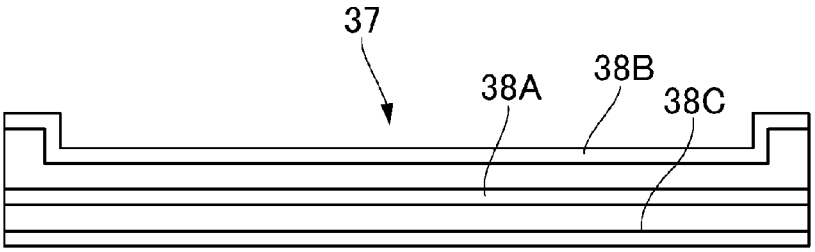

In FIG. 5, (a) and (b) are illustrations of a reinforcing structure for a layer thickness regulating member in Embodiment 2. In FIG. 5, (a) shows a cross-section H in FIG. 3, and (b) is the illustration of arrangement of reinforcing rib portions as seen from an arrow Vt direction in (a) of FIG. 5. Embodiment 2 is constituted and used in the same manner as in Embodiment 1 except that there is no wall rib at each of longitudinal end portions of a layer thickness regulating member 37. Accordingly, constituent elements in FIG. 5 common to Embodiments 1 and 2 are represented by reference numerals or symbols common to FIGS. 4 and 5 and will be omitted from redundant description.

As shown in (a) of FIG. 5, with respect to the layer thickness regulating member 37 in this embodiment, similarly as in Embodiment 1, forces F1 and F2 are assumed as a load exerted on the layer thickness regulating member 37. Further, flexural rigidity against the force F1 is ensured by a cross-sectional length L1 of the layer thickness regulating member 37, and flexural rigidity against the force F2 is ensured by a cross-sectional length L3 (=L2+t1) of the layer thickness regulating member 37.

As shown in (b) of FIG. 5, in this embodiment, the toner regulating member 37 is provided with only reinforcing rib portions 38A, 38B and 38C extending in a rotational axis direction of the developing sleeve 70 but is not provided with a reinforcing rib portion extending in a rotational direction of the developing sleeve 70. The reinforcing rib portion 38A having a height L2 plays a dominant part with respect to geometrical moment of inertia against the force F2. The reinforcing rib portion 38A continuously has the same area and shape from a position where the layer thickness regulating member 37 contacts the sleeve bearing member 11*a* to a position where the layer thickness regulating member 37 contacts the sleeve bearing member 11*b*. In a halfway section from the sleeve bearing member 11*a* to the sleeve bearing member 11*b*, the reinforcing rib portion (vertical rib) crossing the reinforcing rib portion 38A is not provided at all.

In this embodiment, even the wall ribs 40 ((b) of FIG. 4) are not provided at the end portions of the layer thickness regulating member 37. However, even when the wall ribs 40 are not used, in an assembly state shown in FIG. 3, the sleeve bearing members 11*a* and 11*b* play a part equivalent to the wall ribs 40, and therefore the substantially same strength and anti-bending property as those in Embodiment 1 can be obtained. As shown in (b) of FIG. 5, by disposing the reinforcing rib portions 38A, 38B and 38C as parts of the layer thickness regulating member 37, even when the warpage due to thermal deformation is included in addition to flexure by the forces F1 and F2, straightness of the layer thickness regulating portion 36 is suppressed to 20-30 μm or less.

In the case of no wall ribs 40, a contact area between the layer thickness regulating member 37 and each of the sleeve bearing members 11*a* and 11*b* is decreased, and therefore as a fixing method, compared with a fixing method in which opposing surfaces are bonded to each other, e.g., laser welding, UV bonding or the like is suitable. Also from the viewpoint of fixing strength, the laser welding or the UV bonding is excellent.

Effect of Embodiment 2

In the developing device in Embodiment 2, even when the layer thickness regulating member 37 is a resin-molded product, a degree of flexure by the forces F1 and F2 can be suppressed to a desired value or less. As a result, a stable image density can be obtained. The layer thickness regulating portion and the developer rectifying portion can be realized by an inexpensive resin molding process. Further, a cumbersome adjusting operation performed in a conventional doctor blade member is simplified, so that a factor of image defect caused by metal powder can be reduced.

Embodiment 3

Figure 6:
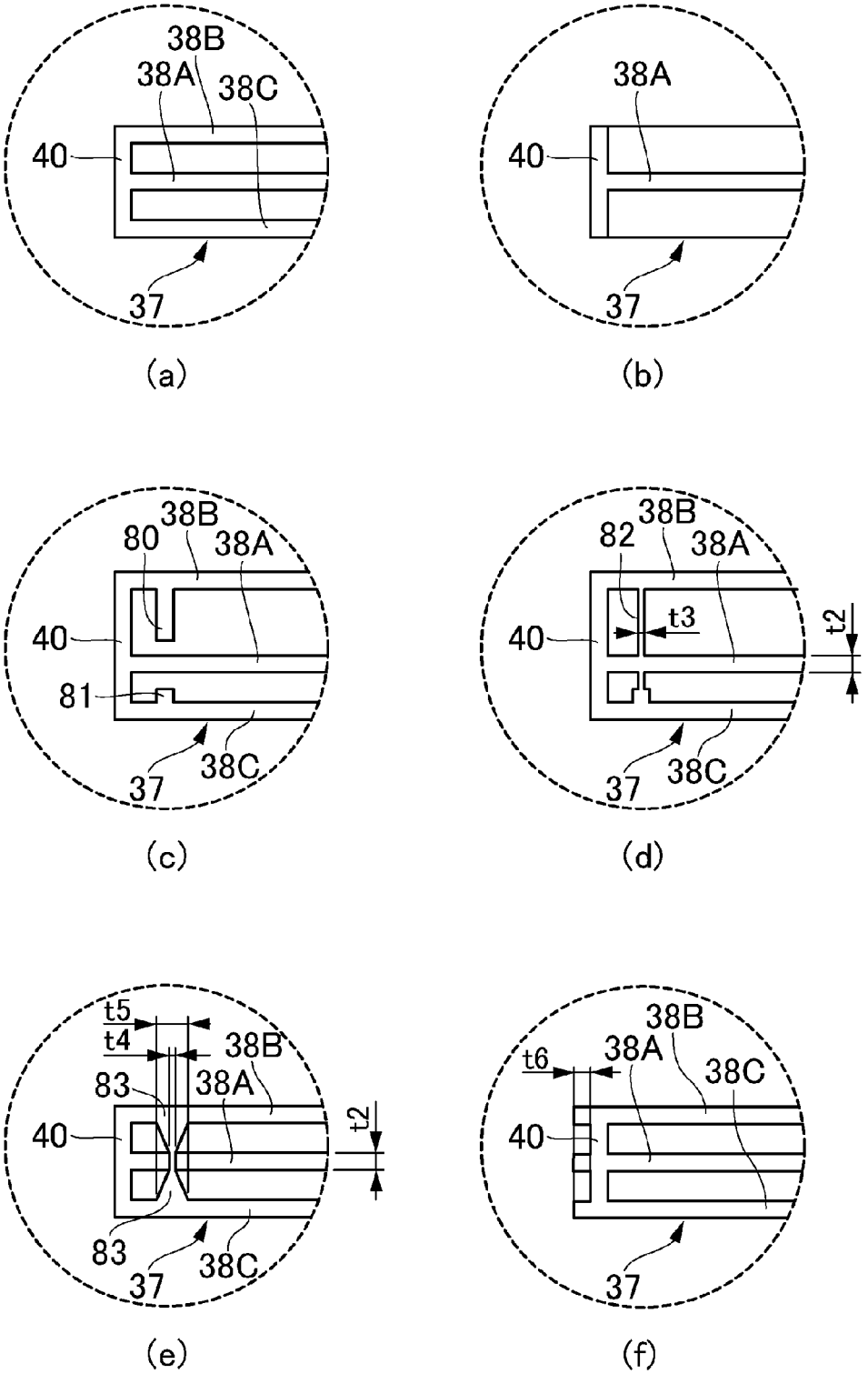
In FIG. 6, (*a*) to (*f*) are illustrations each showing a reinforcing structure for a layer thickness regulating member in Embodiment 3.

In FIG. 6, (*a*) to (*f*) are illustrations each showing a reinforcing structure of a layer thickness regulating member in Embodiment 3. In FIG. 6, each of (a) to (f) is an enlarged view in a region corresponding to the region circled by a dotted line in (b) of FIG. 4. In FIG. 6, (*a*) and (*b*) are examples in which only a wall rib is connected with longitudinal rib(s). In FIG. 6, (*c*), (*d*), (*e*) and (*f*) are examples in which a vertical rib can be regarded as being not substantially connected with a longitudinal rib.

Embodiment 2 is constituted and used in the same manner as in Embodiment 1 except that a layer thickness regulating member 37 is provided with a vertical rib. Accordingly, constituent elements in FIG. 6 common to Embodiments 1 and 3 are represented by reference numerals or symbols common to FIGS. 4 and 6 and will be omitted from redundant description.

Each of the examples of (a) to (f) of FIG. 6 is an arrangement example of reinforcing rib portions capable of reducing a degree of generation of a local difference between a peak and a bottom of a thermal stress distribution. In either example, it was confirmed by an experiment that a level of straightness of 20-30 μm or less was able to be achieved even when flexure by forces F1 and F2 and warpage due to thermal deformation are included.

In Embodiment 3, in a region other than the region corresponding to the region circled by the dotted line in (b) of FIG. 4, in any cross-section perpendicular to an axis direction of the developing sleeve 70, a straight shape is formed similarly as in (a) of FIG. 4. The layer thickness regulating member 37 has a bilaterally symmetrical shape with respect to a longitudinal center line as a symmetrical axis.

In Embodiment 3-1 shown in (a) of FIG. 6, reinforcing rib portions 38A, 38B and 38C are provided so as to extend over between wall ribs 40 provided at longitudinal ends of the layer thickness regulating member 37. In a halfway section between the wall ribs 40 provided at the ends of the layer thickness regulating member 37, another rib crossing the reinforcing rib portions 38A, 38B and 38C is not provided at all.

The wall ribs 40 are vertical ribs disposed at longitudinal end portions of the layer thickness regulating member 37, and therefore substantially contribute to rigidity reinforcing for the reinforcing rib portion 38A but do not cause warpage deformation of the layer thickness regulating member 37 with a heat cycle of heating and cooling. The wall ribs 40 is, in addition to an effect of substantially contributing to the rigidity reinforcing for the reinforcing rib portion 38A, effective for ensuring a bonding area between the layer thickness regulating member 37 and each of the sleeve bearing members 11*a* and 11*b*.

In Embodiment 3-2 shown in (b) of FIG. 6, only a reinforcing rib portion 38A is provided so as to extend over between wall ribs 40 provided at longitudinal ends of the layer thickness regulating member 37. In a halfway section between the wall ribs 40 provided at the ends of the layer thickness regulating member 37, another rib crossing the reinforcing rib portion 38A is not provided at all. With respect to rigidity against a bending force by the force F2 shown in (a) of FIG. 4, the reinforcing rib portion 38A having the maximum height L2 is dominant. For this reason, in an actuation and temperature rise process of the developing device, if a bending amount of the layer thickness regulating member 37 is a permitted value or less, it is enough that only the reinforcing rib portion 38A is provided.

In Embodiment 3-3 shown in (c) of FIG. 6, vertical ribs 80 and 81 are formed at outside surfaces of the layer thickness regulating member 37 with respect to a developer feeding direction, but do not cross the reinforcing rib portion 38A having the maximum height L2. Accordingly, this embodiment is characterized in that a rib crossing the reinforcing rib portion 38*a* is not provided at all in a halfway section.

However, the vertical ribs 80 and 81 are positioned toward a central side by 1 mm or more from each of ends of the layer thickness regulating member 37, and therefore if the vertical ribs 80 and 81 are connected with the reinforcing rib portion 38A, this embodiment is an example in which a vertical reinforcing rib is substantially provided. When the vertical reinforcing rib connected with the opposing portion and with the longitudinal reinforcing rib is substantially provided, it is not preferable that warpage deformation of the layer thickness regulating member 37 is generated with the heat cycle of heating and cooling.

In Embodiment 3-4 shown in (d) of FIG. 6, a vertical rib 82 is formed at an outside surface of the layer thickness regulating member 37 with respect to the developer feeding direction and crosses the longitudinal reinforcing rib portion 38A. However, compared with the reinforcing rib portion 38A having a thickness t2, the vertical rib 82 has a sufficiently thin thickness t3, and therefore, when a change in operation environment (temperature and humidity) generates, the vertical rib 82 little contributes to a difference between a peak and a bottom of a local thermal stress distribution of the layer thickness regulating member 37. The sufficiently thin thickness means a relation of an areal ratio of 25% or less such that t3 is 0.5 mm relative to t2=2.0 mm.

Even when the vertical rib 82 is connected with the reinforcing rib portion 38A, the vertical rib 82 is thin and does not contribute to rigidity reinforcement of the reinforcing rib portion 38A, and therefore the vertical rib 82 can be regarded as being not substantially connected as described above.

In Embodiment 3-5 shown in (e) of FIG. 6, a vertical rib 83 is formed at an outside surface of the layer thickness regulating member 37 with respect to the developer feeding direction and crosses the longitudinal reinforcing rib portion 38A. However, compared with the reinforcing rib portion 38A having a thickness t2, the vertical rib 83 is gradually decreased in thickness from a base portion having the thickness t5 (nearly equal to t2), and is connected with the reinforcing rib portion 38A at a thin end portion having the thickness t4. At a connected portion, compared with the thickness t2, the thickness t4 is sufficiently thin, thus resulting in a considerable difference in cross-sectional area between the reinforcing rib portion 38A and the vertical rib 83. For this reason, with a temperature change, thermal distortion little generates in the reinforcing rib portion 38A. The sufficiently thin thickness means a relation of an areal ratio of 25% or less such that t4 is 0.5 mm relative to t2=2.0 mm.

Even when the vertical rib 83 is connected with the reinforcing rib portion 38A, the connected area between the reinforcing rib portion 38A and the vertical rib 83 is small and does not contribute to rigidity reinforcement of the reinforcing rib portion 38A, and therefore the vertical rib 83 can be regarded as being not substantially connected.

In Embodiment 3-6 shown in (f) of FIG. 6, the layer thickness regulating member 37 is provided with only a reinforcing rib portion 38A crossing and connecting with wall ribs 40. In a halfway section between the wall ribs 40 provided at end portions of the layer thickness regulating member 37, another rib crossing the reinforcing rib portion 38A is not provided at all. Each of the wall ribs 40 has the thickness of 2 mm equal to the thickness of the reinforcing rib portion 38A, and therefore there is a possibility that each of the wall ribs 40 is problematic as the vertical rib connected with the reinforcing rib portion 38A. However, when the layer thickness regulating member 37 in which a gap between the reinforcing rib portion 38A and each of the wall ribs 40 is 1 mm is prototyped, in an actuation and temperature rise process of the developing device, it was confirmed that a flexure amount of the layer thickness regulating member 37 was 20-30 μm or less as a permitted value. Accordingly, if the gap between the wall rib 40 and the reinforcing rib portion 38A is 50% or less of the thickness of the reinforcing rib portion 38A, the wall rib 40 can be regarded as being not substantially connected with the reinforcing rib portion 38A.

In the case where the vertical rib is connected with the reinforcing rib portion 38A and contributes to the rigidity reinforcement of the reinforcing rib portion 38A, when the vertical rib is formed at each of the end portions of the layer thickness regulating member 37, serious warpage deformation of the layer thickness regulating member 37 with heat cycle of heating and cooling is not generated. Each of the end portions is defined as a range of 1 mm from an associated longitudinal end of the reinforcing rib portion 38A. A vertical rib spaced from each of the longitudinal ends of the reinforcing rib portion 38A by more than 1 mm is defined as a longitudinal reinforcing rib.

Incidentally, the gap between the wall rib 40 and the reinforcing rib portion 38A can be used as a filling space or a clearance space for an adhesive when the sleeve bearing members 11*a* and 11*b* and the layer thickness regulating member 37 are bonded to each other.

As described above, in the case of the vertical rib which has the thickness t4 sufficiently thinner than the thickness t2 of the reinforcing rib portion 38A and which is connected with the reinforcing rib portion 38A, the layer thickness regulating member 37 is unable to resist a force for expanding or contracting the layer thickness regulating member 37 with respect to the longitudinal direction due to a change in temperature and humidity. For that reason, at the connected portion with the vertical rib, the reinforcing rib portion 38A does not readily cause thermal distortion or a difference between a peak and a bottom of a local thermal stress distribution. As a result, as shown in (b) of FIG. 4, it was understood that the layer thickness regulating member 37 merely caused displacement in the arrow K directions, and the influence on the straightness of the developer rectifying portion 35 and the layer thickness regulating portion 36 became very small.

Effect of Embodiment 3

In the developing device in Embodiment 3, although the vertical rib which does not contribute to rigidity reinforcement of the reinforcing rib portion 38A is provided, the vertical rib contributing to the rigidity reinforcement is not provided, and therefore, in a process of a temperature change during actuation of the developing device, thermal deformation and warpage are not readily generated on the layer thickness regulating member 37.

Embodiment 4

Figure 7:
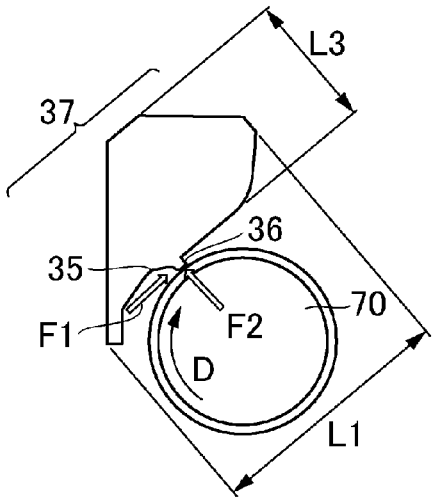
In FIG. 7, (*a*) and (*b*) are illustrations of a reinforcing structure for a layer thickness regulating member in Embodiment 4.
Figure 7:
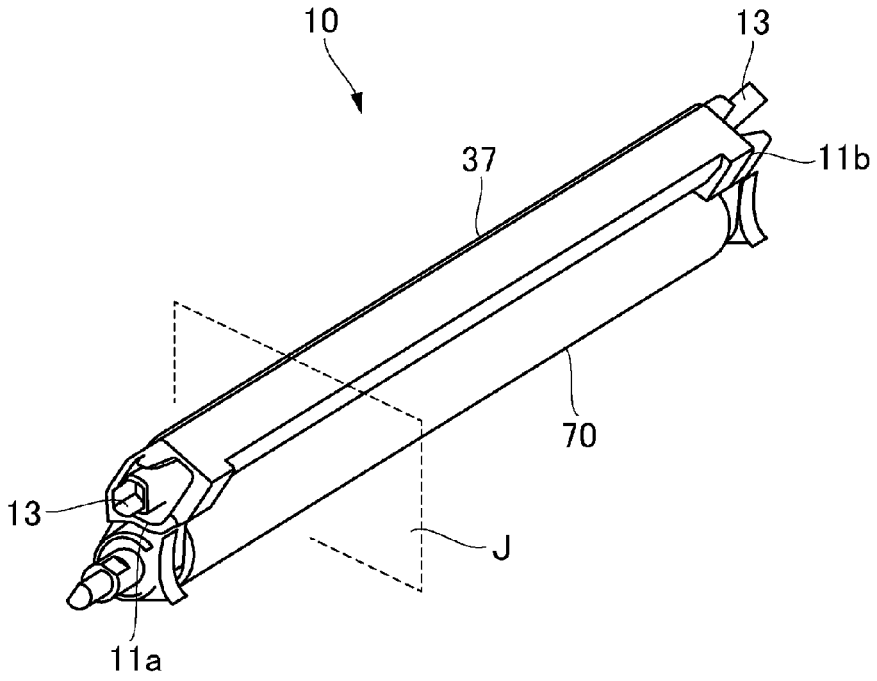

In FIG. 7, (*a*) and (*b*) are illustrations of a reinforcing structure for a layer thickness regulating member in Embodiment 4. In FIG. 5, (a) shows a cross-section J in (b) of FIG. 7, and (b) is a perspective view of a developing sleeve unit. Embodiment 4 is constituted and used in the same manner as in Embodiment 1 except that a rear portion of a layer thickness regulating member 37 is formed in a block-like shape and is not provided with a reinforcing rib portion. Accordingly, constituent elements in FIG. 7 common to Embodiments 1 and 4 are represented by reference numerals or symbols common to FIGS. 4 and 7 and will be omitted from redundant description.

As shown in (a) of FIG. 7, with respect to the layer thickness regulating member 37 in this embodiment, similarly as in Embodiment 1, forces F1 and F2 are assumed as a load exerted on the layer thickness regulating member 37. Further, flexural rigidity against the force F1 is ensured by a cross-sectional length L1 of the layer thickness regulating member 37, and flexural rigidity against the force F2 is ensured by a cross-sectional length L3 of the layer thickness regulating member 37.

However, the layer thickness regulating member 37 has a shape such that there is no hollow portion in any cross-section perpendicular to the longitudinal direction as shown in (a) of FIG. 7. The layer thickness regulating member 37 has the shape such that the same cross-sectional shape continuously extends over the whole area in the longitudinal direction. The shape of the layer thickness regulating member 37 is realized by a foam molding process using a resin material, a drawing process using a metal material such as aluminum, or an extruding process. Incidentally, as shown in (b) of FIG. 7, the layer thickness regulating member 37 may partly have a shape such as a hole for fastening with a screw or a boss for positioning at each of end portions a bonding surface to the sleeve bearing members 11*a* and 11*b*.

Effect of Embodiment 4

In the developing device in Embodiment 4, a thermal stress distribution of the layer thickness regulating member 37 with a change in operation environment (temperature and humidity) becomes uniform. Further, geometrical moment of inertia of the layer thickness regulating member 37 is sufficiently ensured, and therefore flexural rigidity against the forces F1 and F2 can be sufficiently ensured. Accordingly, even when a flexure amount by the forces F1 and F2 and a warpage amount due to the thermal deformation are included, a variation in straightness of the layer thickness regulating portion 36 can be suppressed to 20-30 μm or less. As a result, it is possible to realize the developing device capable of providing a stable image density.

Embodiment 5

The present invention can be carried out also in other embodiments in which a part or all of constituent elements in the above-described embodiments are replaced with alternative constituent elements thereof so long as the layer thickness regulating member formed integrally with the layer thickness regulating portion is reinforced with the reinforcing rib. When the developing device and the process cartridge include the toner regulating member formed integrally with the layer thickness regulating portion, Embodiments 1 to 4 are capable of being carried out. When the image forming apparatus includes such a developing device or a process cartridge, the developing device according to the present invention and the process cartridge are capable of being carried out irrespective of a monochromatic machine (image forming apparatus) and a color machine (image forming apparatus).

The image forming apparatus can be carried out irrespective of a difference between one-drum type and tandem type and a difference between intermediary transfer type and a recording material feeding member type. The image forming apparatus can also be carried out irrespective of the number of image bearing members, a charging type of the image bearing members, an electrostatic image forming type, a transfer type, and the like.

Further, in the above-described embodiments, only a principal portion relating to toner image formation and transfer is described, but the present invention can be carried out in image forming apparatuses, having various uses, such as printers, various printing machines, copying machines, facsimile machines, and multi-function machines, by adding necessary equipment, devices and casing structures.

The effects of Embodiments 1 to 4 are not limited to those with respect to the resin material, but may be similarly obtained even in the case where the layer thickness regulating member is formed by a molding process (e.g., die casting) using a metal material.

In Embodiments 1 to 4, the case of the developing device is described as an example, but effects similar to those in Embodiments 1 to 4 can be obtained also in the case where the present invention is carried out in the process cartridge which is integrally assembled with the photosensitive drum or the like into an exchanging unit and which is detachably mountable to the image forming apparatus.

Comparison Example 1

Figure 8:
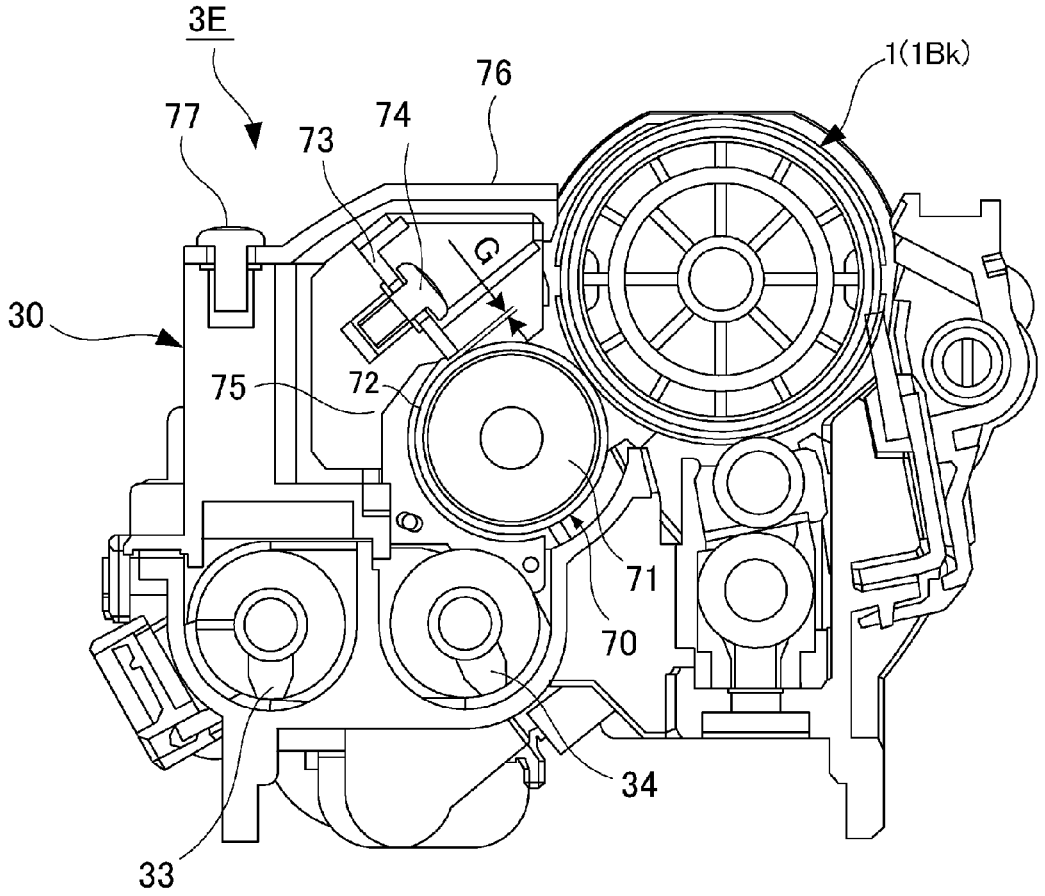
FIG. 8 is a sectional view of a process cartridge in which a developing device in Comparison Example 1 is mounted.

FIG. 8 is a sectional view of a process cartridge in which a developing device 3E in Comparison Example 1 is mounted.

As shown in FIG. 8, a sleeve pipe 72 constituting an outer shell of a developing sleeve 70 is rotatable relative to a developing container 30. A magnet 71 provided inside the sleeve pipe 72 is supported non-rotatably relative to the developing container 30 in a state in which magnetic poles thereof are fixed at predetermined phases with respect to a circumferential direction.

A layer thickness regulating member (doctor blade) 73 is provided opposed to a surface of the developing sleeve 70 at a free end portion thereof, and a SB gap G is not in a desired range. The layer thickness regulating member 73 is required to have a non-magnetic property and high rigidity, and therefore a metal plate member formed of stainless steel is used in general. An erected chain-shaped developer carried on the developing sleeve 70 passes through the SB gap G, so that a developer coating layer having a uniform thickness is formed.

In the developing device 3E in Comparison Example 1, the layer thickness regulating member 73 is fixed with adjusting screws 74 and a base member 75 also functioning as a developer rectifying member. The SB gap G is required to show a uniform distribution with respect to a longitudinal direction (perpendicular to a developer feeding direction). For this reason, in the developing device 3E in Comparison Example 1, in a loosened state of the adjusting screws 74, the layer thickness regulating member 73 is moved so that the SB gap G where a free end thereof and the developing sleeve 70 opposes each other falls within a desired range, and then the adjusting screws 74 are fastened to the base member 75.

In the developing device 3E in Comparison Example 1, the layer thickness regulating member 73 is provided as a separate member from the base member 75, and therefore there is a need to adjust the position of the layer thickness regulating member 73 while taking also a displacement amount into consideration in the case where the adjusting screws 74 are fastened at a plurality of positions. For this reason, a trial-and-error operation is required, so that there is a problem that operating efficiency is lowered.

Comparison Example 2

Figure 9:
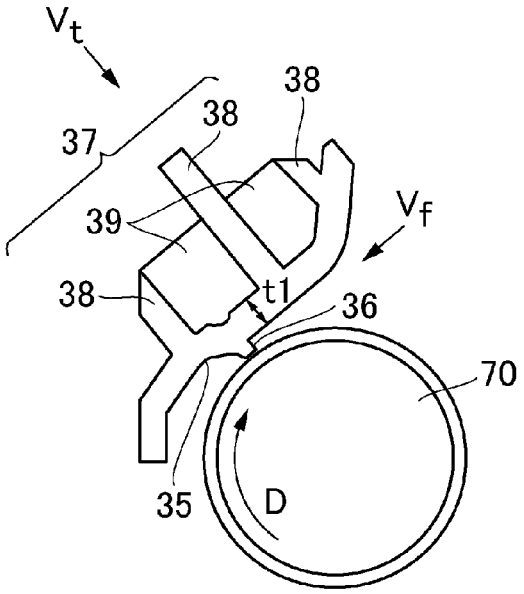
In FIG. 9, (*a*) and (*b*) are illustrations of a reinforcing structure for a layer thickness regulating member in Comparison Example 2.
Figure 9:
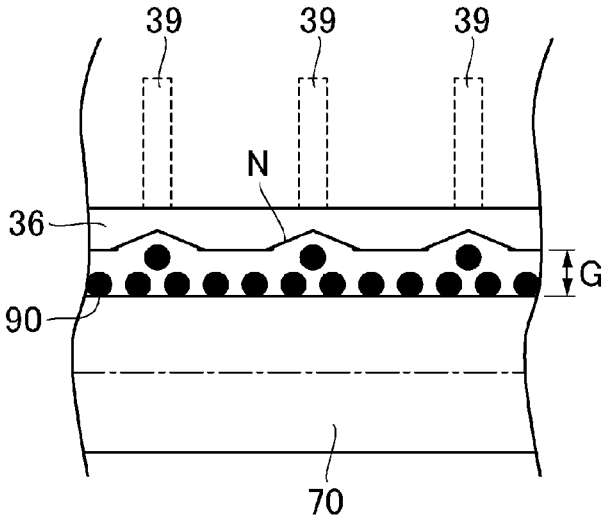
Figure 10:
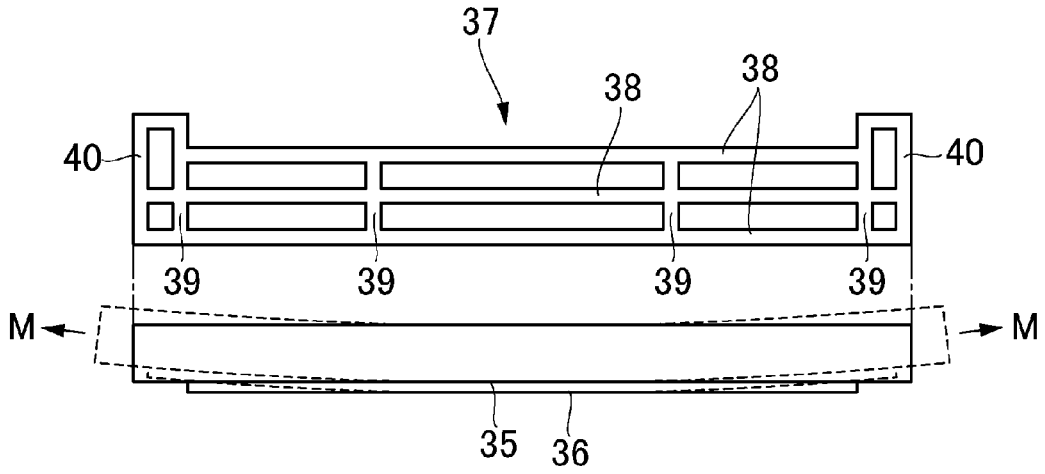
FIG. 10 is an illustration of arrangement of regulating ribs in Comparison Example 2.

In FIG. 9, (*a*) and (*b*) are illustrations of a reinforcing structure for a layer thickness regulating member 37 in Comparison Example 2. FIG. 10 is an illustration of arrangement of a reinforcing ribs in Comparison Example 2.

As shown in (a) of FIG. 9, in Comparison Example 2, by using a resin material, the layer thickness regulating member 37 is provided with reinforcing rib portions 38 each continuously extending in a longitudinal direction and a plurality of vertical ribs 39 as a unit, so that desired rigidity is ensured. The layer thickness regulating member 37 in Comparison Example 2 is provided with a developer rectifying portion 35 and a layer thickness regulating portion 36 which are disposed at a surface opposing the developing sleeve 70 rotating in an arrow D direction. As shown in FIG. 10, on a surface (side) of the layer thickness regulating member 37 opposite from the surface (side) where the layer thickness regulating portion 36 is formed, three reinforcing rib portions 38 each continuously extending in the longitudinal direction and four vertical ribs 39 crossing the reinforcing rib portions 38 are formed.

In the case of the resin material, sink and warpage with a molding process are problematic. In FIG. 9, (b) is the illustration of the layer thickness regulating member 37 as seen from an arrow Vf direction shown in (a) of FIG. 9. As shown in (b) of FIG. 9, in Comparison Example 2, improper straightness of the layer thickness regulating member 37 generates. The layer thickness regulating member 37 generates small recessed portions N due to expansion and contraction after molding only at portions opposing the vertical ribs 39, and therefore an amount of a developer 90 to be coated on the developing sleeve 70 fluctuates every place in the form following the recessed portions of an SB gap.

In the case of the resin material, displacement with a fluctuation in operation environment (temperature and humidity) is problematic. As shown in FIG. 10 by a broken line, in Comparison Example 2, there is a problem of warpage of the layer thickness regulating member 37 with the change in temperature and humidity. With respect to expansion and contraction displacement of the layer thickness regulating member 37 with the change in temperature and humidity, by the presence of the vertical ribs 39, a locally high thermal stress distribution generates in the layer thickness regulating member 37. As a result, a difference in displacement is generated between a surface of the layer thickness regulating portion 36 and a disposing surface, opposite from the surface, where the reinforcing rib portions 38 are disposed. As a result, displacement with warpage as indicated by arrows M is generated, so that the SB gap becomes non-uniform with respect to the longitudinal direction.

When the SB gap becomes non-uniform with respect to the longitudinal direction, the layer thickness of the developer carried on the developing sleeve 70 varies to cause image density non-uniformity. In order not to generate the image density non-uniformity in general, the straightness and warpage of the layer thickness regulating portion 36 are required to be at a level of 20-30 μm or less. For that reason, even slight expansion and contraction resulting from the arrangement of the reinforcing rib portions 38 and the vertical ribs 39 adversely affects image density uniformity.

Further, the sink and warpage with the molding process and the displacement with the fluctuation in operation environment (temperature and humidity) vary widely depending on the arrangement of the reinforcing rib portions. For this reason, when only the problem in terms of the rigidity is solved by disposing the reinforcing rib portions 38 and the vertical ribs 39 randomly, there is a possibility that a function of uniformly regulating the layer thickness of the developer is impaired.

(Geometrical Moment of Inertia)

As shown in (a) of FIG. 4, in Embodiments 1 to 4, the geometrical moment of inertia of the layer thickness regulating member 37 with respect to the force F2 direction in cross-section perpendicular to the rotational axis direction of the developer carrying member constitutes flexural rigidity of the layer thickness regulating member 37 against the force F2.

The reinforcing rib portions 38 are provided for the purpose of ensuring necessary rigidity against a developer pressure (force F2) acting at the SB gap (minimum gap between the layer thickness regulating portion 36 and the developing sleeve 70).

As shown in (a) of FIG. 4, a coordinate axis T with respect to a tangential direction of the developing sleeve at the SB gap and a coordinate axis N with respect to a normal direction of the developing sleeve 70 are defined. In this case, geometrical moment of inertia of the layer thickness regulating member 37 against the force F2 in whole cross-section of the layer thickness regulating member 37 is the sum of individual components of geometrical moment of inertia of the base surface 37B, the layer thickness regulating member 37 and the reinforcing rib portions 38A, 38B and 38C with respect to the coordinate axis T.

Further, the central reinforcing rib portion 38A is higher than the side reinforcing rib portions 38B and 38C, and therefore a proportion of partial geometrical moment of inertia to the geometrical moment of inertia in the whole cross-section of the layer thickness regulating member 37 exceeds 30%. For this reason, as shown in FIG. 10, in the case where the reinforcing rib portions 39 are connected with the reinforcing rib portion 38A, when the layer thickness regulating member 37 is repetitively subjected to the heat cycle of heating and cooling, the layer thickness regulating member 37 causes permanent deformation due to warpage as indicated by the broken line in FIG. 10.

As shown in (a) of FIG. 4, the side reinforcing rib portions 38B and 38C with respect to the rotational direction of the developing sleeve 70 are low in height, and therefore a proportion of partial geometrical moment of inertia to the geometrical moment of inertia in the whole cross-section of the layer thickness regulating member 37 is less than 30%. For this reason, as shown in (c), (d) and (e) of FIG. 6, even when the reinforcing rib portion 39 is connected with the reinforcing rib portions 38B and 38C, the layer thickness regulating member 37 does not generate the permanent deformation due to the warpage.

However, if the side reinforcing rib portions 38B and 38C have the same height as the central reinforcing rib portion 38A, the proportions of the partial geometrical moment of inertia to the geometrical moment of inertia in the whole (vertical) cross-section of the layer thickness regulating member 37 approaches 60% and thus exceeds 30%. For this reason, as shown in (c), (d) and (e) of FIG. 6, when the reinforcing rib portion 39 is connected with the reinforcing rib portions 38B and 38C, by the influence of the thermal deformation, the layer thickness regulating member 37 causes the permanent deformation due to the warpage.

In the developing device in the present invention, there is substantially no place where the distortion is generated in the longitudinal reinforcing rib portion, i.e., a portion where the vertical reinforcing rib portion is connected with the longitudinal reinforcing rib portion, and therefore partial distortion of the longitudinal reinforcing rib portion is not gradually increased even when the heat cycle of heating and cooling is repeated. With repetition of the heat cycle of heating and cooling to which the layer thickness regulating member is subjected, substantial flexure (bending) such that the distortion at the portion where the vertical reinforcing rib portion is connected with the longitudinal reinforcing rib portion is gradually increased to impair the function of the layer thickness regulating member as a whole does not appear.

The term "substantially" includes the case where the distortion is not increased by the repetition of the heat cycle of heating and cooling. Further, even when the distortion is gradually increased, also the case where an increasing speed does not reach a speed at which the increased distortion leads to the flexure of the layer thickness regulating member as a whole such that an inconvenience is caused in the toner regulation of the developer through at least a durability lifetime period of the developing device, is included. The case where the vertical reinforcing rib portion is not substantially formed refers to the case where the presence or absence of the connection of the vertical reinforcing rib portion with the longitudinal reinforcing rib portion, the connecting position and the connection area are not those to the extent that the inconvenience is caused in the layer thickness regulation of the developer through the durability lifetime period of the developing device.

Accordingly, the central portion of the layer thickness regulating member with respect to the rotational axis direction of the developer carrying member is not readily flexed (bent) outwardly with the repetition of the heat cycle of heating and cooling, so that it is possible to form the developer layer having a uniform thickness along the rotational axis direction of the developer carrying member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 166634/2013 filed Aug. 9, 2013, which is hereby incorporated by reference.

What is claimed is:

1. A developing device comprising:

a developer carrying member for carrying a developer; and a layer thickness regulating member, integrally molded by a resin material, for regulating a layer thickness of the developer carried on said developer carrying member, wherein said layer thickness regulating member includes an opposing portion opposing a peripheral surface of said developer carrying member; a regulating portion, provided on said opposing portion so as to project toward said developer carrying member, for regulating the layer thickness of the developer carried on said developer carrying member; side wall portions which are provided on said opposing portion so as to project in a rear side opposite from a front side where said regulating portion is provided and which are provided at end portions thereof with respect to a rotational axis direction of said developer carrying member; and a plurality of rib portions, provided on said opposing portion so as to project in the rear side, each extending from said side wall portion in one end side to said side wall portion in the other end side with respect to the rotational axis direction of said developer carrying member, wherein a space is formed in the rear side by being defined by said side wall portions and said rib portions, and wherein no substantial rib portion dividing the space with respect to a longitudinal direction of said layer thickness regulating member is provided.

2. A developing device according to claim 1, further comprising a supporting portion for supporting said layer thickness regulating member movably relative to a device main assembly in the rotational axis direction of said developer carrying member.

3. A developing device according to claim 1, wherein each of said side wall portions is formed within a range of 1 mm from an associated end of said layer thickness regulating member.

4. A developing device according to claim 1, wherein said regulating portion is formed only in a region corresponding to an interval between associated adjacent two rib portions.

5. A developing device according to claim 1, wherein said opposing portion includes a rectifying portion for rectifying the developer upstream of said regulating portion.

6. A developing device comprising:

a developer carrying member for carrying a developer; and a layer thickness regulating member, integrally molded by a resin material, for regulating a layer thickness of the developer carried on said developer carrying member, wherein said layer thickness regulating member includes an opposing portion opposing a peripheral surface of said developer carrying member; a regulating portion, provided on said opposing portion so as to project toward said developer carrying member, for regulating the layer thickness of the developer carried on said developer carrying member; and a plurality of rib portions, provided on said opposing portion so as to project in a rear side, each extending from one end side to the other end side with respect to the rotational axis direction of said developer carrying member, and wherein with respect to geometrical moment of inertia of said developer carrying member with respect to a tangential direction at a position opposing the regulating portion, of said plurality of rib portions, said rib portion occupying 30% or more of total geometrical moment of inertia is provided so as to be connected with no substantial rib portion extending in a direction crossing the rotational axis direction of said developer carrying member except for said rib portions provided at end portions with respect to the rotational axis direction of said developer carrying member.

7. A developing device according to claim 6, further comprising a supporting portion for supporting said layer thickness regulating member movably relative to a device main assembly in the rotational axis direction of said developer carrying member.

8. A developing device according to claim 6, wherein each of said end portions is a region within a range of 1 mm from an associated end of said layer thickness regulating member.

9. A developing device according to claim 6, wherein said regulating portion is formed only in a region corresponding to an interval between associated adjacent two rib portions.

10. A developing device according to claim 6, wherein said opposing portion includes a rectifying portion for rectifying the developer upstream of said regulating portion.

11. A layer thickness regulating member, integrally molded by a resin material, for regulating a layer thickness of a developer carried on a developer carrying member, said layer thickness regulating member comprising:

an opposing portion opposing a peripheral surface of the developer carrying member;

a regulating portion, provided on said opposing portion so as to project toward the developer carrying member, for regulating the layer thickness of the developer carried on the developer carrying member;

side wall portions which are provided on said opposing portion so as to project in a rear side opposite from a front side where said regulating portion is provided and which are provided at end portions thereof with respect to a rotational axis direction of the developer carrying member; and a plurality of rib portions, provided on said opposing portion so as to project in the rear side, each extending from one end side to the other end side with respect to the rotational axis direction of the developer carrying member, wherein a space is formed in the rear side by being defined by said side wall portions and said rib portions, and wherein no substantial rib portion dividing the space with respect to a longitudinal direction of said layer thickness regulating member is provided.

12. A layer thickness regulating member device according to claim 11, wherein each of said side wall portions is formed within a range of 1 mm from an associated end of said layer thickness regulating member.

13. A layer thickness regulating member according to claim 11, wherein said regulating portion is formed only in a region corresponding to an interval between associated adjacent two rib portions.

14. A layer thickness regulating member according to claim 11, wherein said opposing portion includes a rectifying portion for rectifying the developer upstream of said regulating portion.

15. A layer thickness regulating member, integrally molded by a resin material, for regulating a layer thickness of a developer carried on a developer carrying member, said layer thickness regulating member comprising:

an opposing portion opposing a peripheral surface of the developer carrying member;

a regulating portion, provided on said opposing portion so as to project toward the developer carrying member, for regulating the layer thickness of the developer carried on the developer carrying member; and a plurality of rib portions, provided on said opposing portion so as to project in the rear side, each extending from a side wall portion in one end side to a side wall portion in the other end side with respect to the rotational axis direction of the developer carrying member, and wherein with respect to geometrical moment of inertia of the developer carrying member with respect to a tangential direction at a position opposing said regulating portion, of said plurality of rib portions, said rib portion occupying 30% or more of total geometrical moment of inertia is provided so as to be connected with no substantial rib portion extending in a direction crossing the rotational axis direction of the developer carrying member except for said rib portions provided at end portions with respect to the rotational axis direction of the developer carrying member.

16. A layer thickness regulating member according to claim 15, wherein each of said end portions is a region within a range of 1 mm from an associated end of said layer thickness regulating member.

17. A layer thickness regulating member according to claim 15, wherein said regulating portion is formed only in a region corresponding to an interval between associated adjacent two rib portions.

18. A layer thickness regulating member according to claim 15, wherein said opposing portion includes a rectifying portion for rectifying the developer upstream of said regulating portion.

19. A regulating member configured to regulate an amount of a developer on a developer carrying member, comprising:

a base portion provided opposed to the developer carrying member;

a regulating portion configured to regulate the amount of developer on the developer carrying member, wherein said regulating portion projects from a front side of said base portion to which the developer carrying member opposes and extends in a rotational axis direction of the developer carrying member;

at least one first rib configured to reinforce said base portion, wherein said first rib projects from a rear side of said base portion and extends in the rotational axis direction of the developer carrying member; and a second rib projecting from the rear side of said base portion and crossing said first rib, wherein said second rib is not provided in a developer carrying region of the developer carrying member but is provided outside the developer carrying region with respect to the rotational axis direction of the developer carrying member.

20. A regulating member according to claim 19, wherein said second rib is only a side wall portion provided at end portions of said base portion with respect to the rotational axis direction of the developer carrying member.

21. A regulating member according to claim 20, wherein said first rib does not project from said side wall portion toward an outside with respect to the rotational axis direction of the developer carrying member or project from said side wall portion toward the outside by a length of not more than 1 mm with respect to the rotational axis direction of the developer carrying member.

22. A regulating member according to claim 19, wherein said base portion, said regulating portion, said first rib and said second rib are integrally molded with a resin material.

23. A regulating member configured to regulate an amount of a developer on a developer carrying member, comprising:

a base portion provided opposed to the developer carrying member;

a regulating portion configured to regulate the amount of developer on the developer carrying member, wherein said regulating portion projects from a front side of said base portion to which the developer carrying member opposes and extends in a rotational axis direction of the developer carrying member;

a plurality of first ribs configured to reinforce said base portion, wherein said first ribs project from a rear side of said base portion and extend in the rotational axis direction of the developer carrying member, and include a maximum rib having a maximum rib height; and a second rib projecting from the rear side of said base portion and formed along a direction crossing said first ribs, wherein said second rib does not cross said maximum rib in a developer carrying region of the developer carrying member with respect to the rotational axis direction of the developer carrying member.

24. A regulating member according to claim 23, wherein said second rib includes a side wall portion provided at end portions of said base portion with respect to the rotational axis direction of the developer carrying member, and wherein of said second rib, only said side wall portion crosses said maximum rib.

25. A regulating member according to claim 24, wherein said first ribs do not project from said side wall portion toward an outside with respect to the rotational axis direction of the developer carrying member or project from said side wall portion toward the outside by a length of not more than 1 mm with respect to the rotational axis direction of the developer carrying member.

26. A regulating member according to claim 23, wherein said base portion, said regulating portion, said first ribs and said second rib are integrally molded with a resin material.

27. A regulating member configured to regulate an amount of a developer on a developer carrying member, comprising:

a base portion provided opposed to the developer carrying member;

a regulating portion configured to regulate the amount of developer on the developer carrying member, wherein said regulating portion projects from a front side of said base portion to which the developer carrying member opposes and extends in a rotational axis direction of the developer carrying member;

a plurality of first ribs configured to reinforce said base portion, wherein said first ribs project from a rear side of said base portion and extend in the rotational axis direction of the developer carrying member, and include a maximum rib having a maximum rib height; and a second rib projecting from the rear side of said base portion and formed along a direction crossing said first ribs, wherein when said second rib crosses said maximum rib in a developer carrying region of the developer carrying member with respect to the rotational axis direction of the developer carrying member, a thickness of said second rib in a region where said second rib is connected with said maximum rib is 50% or less of a thickness of said maximum rib.

28. A regulating member according to claim 27, wherein said second rib includes a side wall portion provided at end portions of said base portion with respect to the rotational axis direction of the developer carrying member, and wherein of said second rib, only said side wall portion crosses said maximum rib.

29. A regulating member according to claim 28, wherein said first ribs do not project from said side wall portion toward an outside with respect to the rotational axis direction of the developer carrying member or project from said side wall portion toward the outside by a length of not more than 1 mm with respect to the rotational axis direction of the developer carrying member.

30. A regulating member according to claim 27, wherein said base portion, said regulating portion, said first ribs and said second rib are integrally molded with a resin material.

31. A regulating member configured to regulate an amount of a developer on a developer carrying member, comprising:

a base portion provided opposed to the developer carrying member;

a regulating portion configured to regulate the amount of developer on the developer carrying member, wherein said regulating portion projects from a front side of said base portion to which the developer carrying member opposes and extends in a rotational axis direction of the developer carrying member;

at least one first rib configured to reinforce said base portion, wherein said first rib projects from a rear side of said base portion and extends in the rotational axis direction of the developer carrying member; and a second rib projecting from the rear side of said base portion and formed along a direction crossing said first rib, wherein in a cross-section perpendicular to the rotational axis direction of the developer carrying member, when a free end of said regulating portion is an origin and a tangential direction and a normal direction of the developer carrying member are coordinate axes, said first rib includes a reinforcing rib in a proportion of partial geometrical moment of inertia to geometrical moment of inertia in an entirety of a cross-section of said regulating member with respect to the coordinate axis of the tangential direction exceeding 30%, and wherein said second rib does not cross said reinforcing rib in a developer carrying region of the developer carrying member with respect to the rotational axis direction of the developer carrying member.

32. A regulating member according to claim 31, wherein said second rib includes a side wall portion provided at end portions of said base portion with respect to the rotational axis direction of the developer carrying member, and wherein of said second rib, only said side wall portion crosses said reinforcing rib.

33. A regulating member according to claim 32, wherein said first rib does not project from said side wall portion toward an outside with respect to the rotational axis direction of the developer carrying member or project from said side wall portion toward the outside by a length of not more than 1 mm with respect to the rotational axis direction of the developer carrying member.

34. A regulating member according to claim 31, wherein said base portion, said regulating portion, said first rib and said second rib are integrally molded with a resin material.

35. A regulating member configured to regulate an amount of a developer on a developer carrying member, comprising:

a base portion provided opposed to the developer carrying member;

a regulating portion configured to regulate the amount of developer on the developer carrying member, wherein said regulating portion projects from a front side of said base portion to which the developer carrying member opposes and extends in a rotational axis direction of the developer carrying member;

at least one first rib configured to reinforce said base portion, wherein said first rib projects from a rear side of said base portion and extends in the rotational axis direction of the developer carrying member; and a second rib projecting from the rear side of said base portion and formed along a direction crossing said first rib, wherein in a cross-section perpendicular to the rotational axis direction of the developer carrying member, when a free end of said regulating portion is an origin and a tangential direction and a normal direction of the developer carrying member are coordinate axes, said first rib includes a reinforcing rib in a proportion of partial geometrical moment of inertia to geometrical moment of inertia in an entirety of a cross-section of said regulating member with respect to the coordinate axis of the tangential direction exceeding 30%, and wherein when said second rib crosses said reinforcing rib in a developer carrying region of the developer carrying member with respect to the rotational axis direction of the developer carrying member, a thickness of said second rib in a region where said second rib is connected with said reinforcing rib is 50% or less of a thickness of said reinforcing rib.

36. A regulating member according to claim 35, wherein said second rib includes a side wall portion provided at end portions of said base portion with respect to the rotational axis direction of the developer carrying member, and wherein of said second rib, only said side wall portion crosses said reinforcing rib.

37. A regulating member according to claim 36, wherein said first rib does not project from said side wall portion toward an outside with respect to the rotational axis direction of the developer carrying member or project from said side wall portion toward the outside by a length of not more than 1 mm with respect to the rotational axis direction of the developer carrying member.

38. A regulating member according to claim 35, wherein said base portion, said regulating portion, said first rib and said second rib are integrally molded with a resin material.

39. A developing device comprising:

a developer carrying member;

a regulating member, provided opposed to said developer carrying member, configured to regulate an amount of a developer on said developer carrying member, said regulating member comprising, a base portion provided opposed to said developer carrying member;

a regulating portion configured to regulate the amount of developer on said developer carrying member, wherein said regulating portion projects from a front side of said base portion to which said developer carrying member opposes and extends in a rotational axis direction of said developer carrying member, at least one first rib configured to reinforce said base portion, wherein said first rib projects from a rear side of said base portion and extends in the rotational axis direction of said developer carrying member, a second rib projecting from the rear side of said base portion and crossing said first rib, wherein said second rib is not provided in a developer carrying region of said developer carrying member but is provided outside the developer carrying region with respect to the rotational axis direction of said developer carrying member, and a supporting portion configured to support each end portion of said regulating member, wherein said supporting portion supports said regulating member so as to be movable in a longitudinal direction of said regulating member.

40. A developing device comprising:

a developer carrying member;

a regulating member, provided opposed to said developer carrying member, configured to regulate an amount of a developer on said developer carrying member, said regulating member comprising, a base portion provided opposed to said developer carrying member;

a regulating portion configured to regulate the amount of developer on said developer carrying member, wherein said regulating portion projects from a front side of said base portion to which the developer carrying member opposes and is extended in a rotational axis direction of said developer carrying member, a plurality of first ribs configured to reinforce said base portion, wherein said first ribs project from a rear side of said base portion and extend in the rotational axis direction of said developer carrying member, and includes a maximum rib having a maximum rib height, a second rib projecting from the rear side of said base portion and formed along a direction crossing said first ribs, and a supporting portion configured to support each end portion of said regulating member, wherein said supporting portion supports said regulating member so as to be movable in a longitudinal direction of said regulating member, wherein said second rib does not cross said maximum rib in a developer carrying region of said developer carrying member with respect to the rotational axis direction of said developer carrying member.

41. A developing device comprising:

a developer carrying member;

a regulating member, provided opposed to said developer carrying member, configured to regulate an amount of a developer on said developer carrying member, said regulating member comprising, a base portion provided opposed to said developer carrying member;

a regulating portion configured to regulate the amount of developer on said developer carrying member, wherein said regulating portion projects from a front side of said base portion to which said developer carrying member opposes and extends in a rotational axis direction of said developer carrying member, a plurality of first ribs configured to reinforce said base portion, wherein said first ribs project from a rear side of said base portion and extend in the rotational axis direction of said developer carrying member, and include a maximum rib having a maximum rib height, a second rib projecting from the rear side of said base portion and formed along a direction crossing said first ribs, and a supporting portion configured to support each end portion of said regulating member, wherein said supporting portion supports said regulating member so as to be movable in a longitudinal direction of said regulating member, wherein when said second rib crosses said maximum rib in a developer carrying region of said developer carrying member with respect to the rotational axis direction of said developer carrying member, a thickness of said second rib in a region where said second rib is connected with said maximum rib is 50 % or less of a thickness of said maximum rib.

42. A developing device comprising:

a developer carrying member;

a regulating member, provided opposed to said developer carrying member, configured to regulate an amount of a developer on said developer carrying member, said regulating member comprising, a base portion provided opposed to said developer carrying member, a regulating portion configured to regulate the amount of developer on said developer carrying member, wherein said regulating portion projects from a front side of said base portion to which said developer carrying member opposes and extends in a rotational axis direction of said developer carrying member, at least one first rib configured to reinforce said base portion, wherein said first rib projects from a rear side of said base portion and extends in the rotational axis direction of said developer carrying member, a second rib projecting from the rear side of said base portion and formed along a direction crossing said first rib, and a supporting portion configured to support each end portion of said regulating member, wherein said supporting portion supports said regulating member so as to be movable in a longitudinal direction of said regulating member, wherein in a cross-section perpendicular to the rotational axis direction of said developer carrying member, when a free end of said regulating portion is an origin and a tangential direction and a normal direction of said developer carrying member are coordinate axes, said first rib includes a reinforcing rib in a proportion of partial geometrical moment of inertia to geometrical moment of inertia in an entirety of a cross-section of said regulating member with respect to the coordinate axis of the tangential direction exceeding 30%, and wherein said second rib does not cross said reinforcing rib in a developer carrying region of said developer carrying member with respect to the rotational axis direction of said developer carrying member.

43. A developing device comprising:

a developer carrying member;

a regulating member, provided opposed to said developer carrying member, configured to regulate an amount of a developer on said developer carrying member, said regulating member comprising, a base portion provided opposed to said developer carrying member, a regulating portion configured to regulate the amount of developer on said developer carrying member, wherein said regulating portion projects from a front side of said base portion to which said developer carrying member opposes and extends in a rotational axis direction of said developer carrying member, at least one first rib configured to reinforce said base portion, wherein said first rib projects from a rear side of said base portion and extends in the rotational axis direction of said developer carrying member, a second rib projecting from the rear side of said base portion and formed along a direction crossing said first rib, and a supporting portion configured to support each end portion of said regulating member, wherein said supporting portion supports said regulating member so as to be movable in a longitudinal direction of said regulating member, wherein in a cross-section perpendicular to the rotational axis direction of said developer carrying member, when a free end of said regulating portion is an origin and a tangential direction and a normal direction of said developer carrying member are coordinate axes, said first rib includes a reinforcing rib in a proportion of partial geometrical moment of inertia to geometrical moment of inertia in an entirety of a cross-section of said regulating member with respect to the coordinate axis of the tangential direction exceeding 30%, and wherein when said second rib crosses said reinforcing rib in a developer carrying region of said developer carrying member with respect to the rotational axis direction of said developer carrying member, a thickness of said second rib in a region where said second rib is connected with said reinforcing rib is 50% or less of a thickness of said reinforcing rib.

44. A developing device comprising:

a developer carrying member;

a regulating member, provided opposed to said developer carrying member, configured to regulate an amount of a developer on said developer carrying member, said regulating member comprising, a base portion provided opposed to said developer carrying member;

a regulating portion configured to regulate the amount of developer on said developer carrying member, wherein said regulating portion projects from a front side of said base portion to which said developer carrying member opposes and extends in a rotational axis direction of said developer carrying member, at least one reinforcing rib configured to reinforce said base portion, wherein said first rib projects from a rear side of said base portion and extends in the rotational axis direction of said developer carrying member, and includes a maximum rib having a maximum rib height, and a supporting portion configured to support each end portion of said regulating member, wherein said supporting portion supports said regulating member so as to be movable in a longitudinal direction of said regulating member, wherein no rib crossing said reinforcing rib is provided at least in a developer carrying region of said developer carrying member with respect to the rotational axis direction of said developer carrying member.

* * * * *